United States Patent [19]

Jessup et al.

[11] 4,083,151

[45] Apr. 11, 1978

[54] ANGULAR FEED CENTERLESS GRINDER

[75] Inventors: Wilbur F. Jessup, The Hague; Rudolf J. A. Kimmelaar, Vlaardingen, both of Netherlands

[73] Assignee: Cincinnati Milacron Inc., Cincinnati, Ohio

[21] Appl. No.: 803,570

[22] Filed: Jun. 6, 1977

[51] Int. Cl.[2] ..... B24B 5/18

[52] U.S. Cl. ..... 51/103 R

[58] Field of Search ..... 51/103 R, 103 WH, 103 TF

[56] References Cited

U.S. PATENT DOCUMENTS

| | | | |
|---|---|---|---|
| 1,676,620 | 7/1928 | Norton | 51/103 WH |
| 1,709,818 | 4/1929 | Binns | 51/103 WH |
| 2,322,619 | 6/1943 | Ekholm | 51/103 TF |
| 2,466,478 | 4/1949 | Riley | 51/103 WH |

FOREIGN PATENT DOCUMENTS

| | | | |
|---|---|---|---|
| 2,153,247 | 5/1973 | Germany | 51/103 R |

*Primary Examiner*—James L. Jones, Jr.
*Assistant Examiner*—Nicholas P. Godici
*Attorney, Agent, or Firm*—Thomas M. Farrell

[57] ABSTRACT

An angular feed centerless grinder having a frusto-conical grinding wheel adapted to simultaneously grind a workpiece diameter and adjacent shoulder by feeding the wheel relative to the workpiece at an angle to the center line of the workpiece, i.e. at the juncture of the work diameter and shoulder. A generally cylindrical regulating wheel is adapted to support and drive the workpiece in a conventional manner. The grinding wheel and regulating wheel are adapted to move relative to the workpiece along their respective line of centers between the wheels and the workpiece, thus establishing an obtuse angle between the feed vectors of the regulating and grinding wheels in the one plane, while an obtuse angle is likewise established between the feed vectors in a second, perpendicular plane.

5 Claims, 15 Drawing Figures

PRIOR ART
FIG. 4
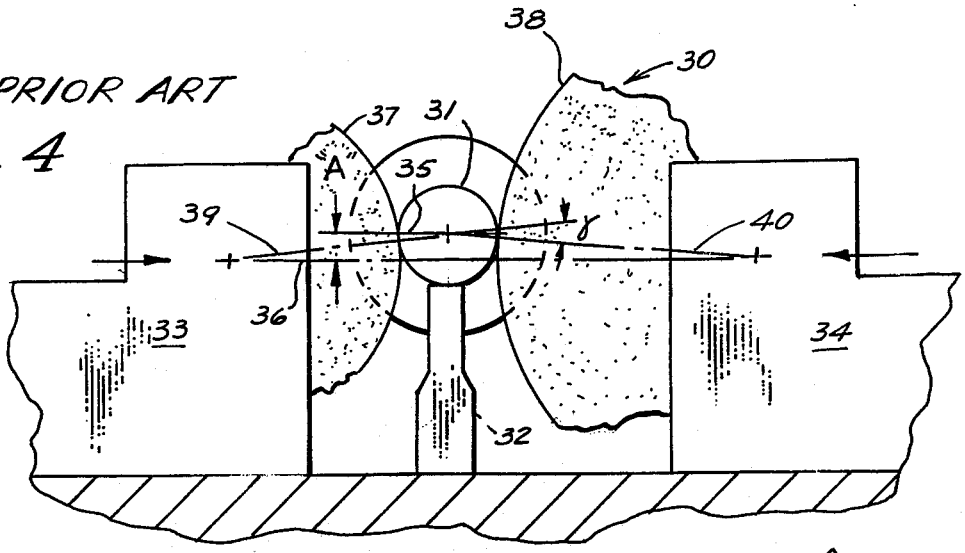
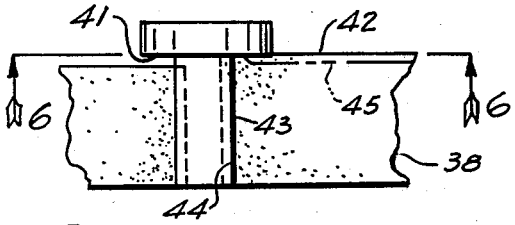
FIG. 5 PRIOR ART
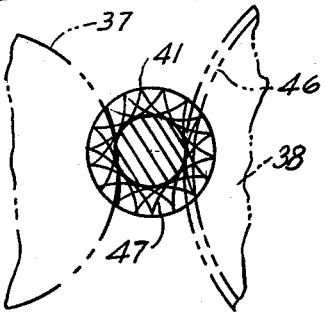
FIG. 6 PRIOR ART
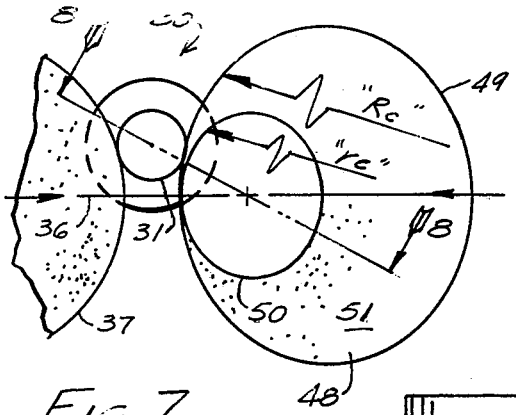
FIG. 7
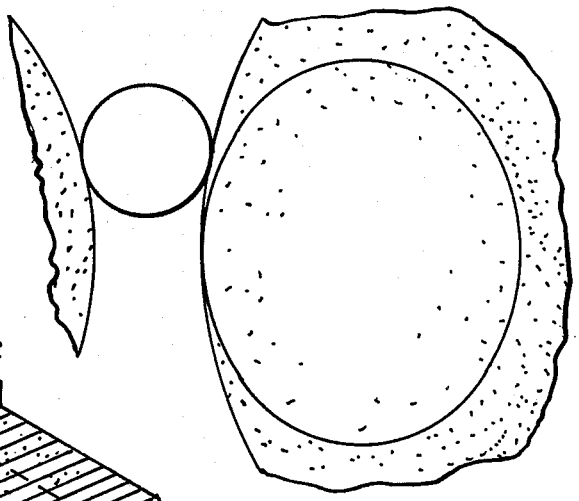
FIG. 7a
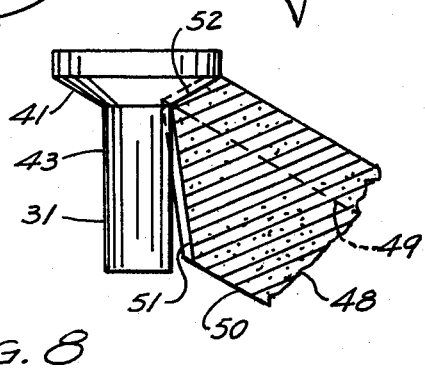
FIG. 8

ANGULAR FEED CENTERLESS GRINDER

BACKGROUND OF THE INVENTION

In conventional centerless grinding as is well-known in the art, a grinder has a grinding wheel and a regulating wheel, oppositely disposed to a work support, located therebetween. The work support carries a workpiece of revolution which is contacted by the respective grinding and regulating wheels. To achieve a "rounding up" action, the work is elevated to such point that its centerline lies above a line of center between the respective regulating and grinding wheels. Thus, a "rounding-up" triangle is established, having a base equal to the line of centers between the two wheels and sides manner to obtain a slight axial feed component for propelling the workpiece toward a positive stop and thrusting the shoulder surface to be ground against the side of the grinding wheel. Difficulties are encountered by grinding with the side of the wheel: rapid deterioration of the side face of the grinding wheel may occur, and a sometimes undesirable "cross-hatching" finish appears on the shoulder as a prior ground surface passes the grinding wheel at a different attitude. To obtain flatness control of the grinding face and to relieve built-up pressures, the wheel is often relieved on the side leaving only a rim of work contacting surface to do the job, and wheel breakdown is accelerated. It has been suggested that a conventional centerless grinder be configured to have frusto-conical surfaces formed on a grinding wheel, wherein the grinding wheel spindle would be canted to the axis of a workpiece and fed along a vector aimed at the juncture of the work diameter and shoulder, as is often done on center type grinders known as "angular wheelslide plunge grinders". One of the most important advantages of angular feed grinding lies in the possibility of reconditioning the wheel profile automatically while maintaining the apex of the profile in the same relationship with the junction of the ground surfaces. In the angular plunge grinder art, however, when viewing the part axially, i.e., in circular cross-section, the wheel faces appear elliptical and have their minor axes coincident with the line of contact of the frusto-conical surface of the wheel along the part.

If a conventional centerless grinder would be fitted with a frusto-conical grinding wheel, and the grinding wheel be swiveled with sides parallel to a juncture-aimed feed vector so as to present a frusto-conical surface parallel to the regulating wheel cylinder and workpiece, it may be seen that, as the workpiece is positioned above the line of centers of the wheels (by necessity), the workpiece would contact the parallel cylinder of the regulating wheel along a line of contact but would contact the grinding wheel only at one end of the wheel, since the minor axes of the ellipses formed by the foreshortened view of the sides of the wheel would be coincident only on the line of centers of the wheels. Therefore, it is seen that the workpiece must be laid along the frusto-conical surface of the grinding wheel such that their axes fall on the same plane. To accomplish this contact with the grinding wheel, a special, articulatable work support fixture would somehow have to be arranged to tilt the workpiece along the frusto-conical face, and the regulating wheel would have to be tilted accordingly around the pivot of the regulating wheel housing in order to contact the workpiece. However, it may now be seen that as the grinding wheel diminishes in diameter due to wear and dressing, and is fed in conventional manner along the line of centers of the wheels, that the workpiece would have to be readapted after a certain amount of wheel wear to a new cone which now comprises the wheel. To date, no such conical wheel work support adapter has been known for a conventional centerless grinder having feed and compensating movements of the wheels along a line of centers between the wheels, with the workpiece being positioned off the line of centers between the wheels.

Applicant has obviated the difficulties inherent in the prior art devices by an angular feed centerless grinder design which readily applies a frusto-conical wheel to a cylindrical workpiece, feeding the regulating wheel and grinding wheel directly toward the workpiece, keeping a constant angle between the feed vectors. Further, a diminished grinding wheel cone will not affect the geometric quality of the workpiece, in that a conical surface is continually presented to contact the finished workpiece along a substantially constant line of contact. A shoulder on a workpiece is further ground to a high degree of flatness by a frusto-conical surface on the grinding wheel, since the frusto-conical surface contacts the shoulder along a substantially constant radial line of contact.

It is therefore an object of the present invention to provide an angular feed centerless grinder having certain substantially constant grind parameters throughout the life of the grinding wheel and the regulating wheel.

It is a further object of the present invention is to provide an angular feed centerless grinder capable of ease of setup about a substantially constant work centerline for a variety of workpiece sizes.

SUMMARY OF THE INVENTION

The invention is shown embodied in a centerless grinder having a frusto-conical grinding wheel engaging a workpiece of revolution along an axial line of contact, wherein during grinding the grinding wheel is fed relatively along the line of centers between the workpiece and the grinding wheel and parallel to the plane of the grinding wheel. An essentially cylindrical regulating wheel, which is rotatably carried in a regulating wheelhead, contacts the workpiece of revolution along a contact line which is less than 180° from the grinding wheel contact line to establish a "rounding-up" action, and during adjustment for wheel wear or workpiece diameter, the regulating wheel is relatively fed towards the workpiece along a line of centers between the workpiece and regulating wheel.

A frusto-conical main surface of revolution on the grinding wheel contacts the workpiece along the axial line of contact on the cylindrical work diameter, while a frusto-conical secondary surface on the grinding wheel, adjacent to the main surface, contacts a shoulder on the workpiece along a line of contact radially of the workpiece.

In the preferred embodiment, the grinding wheel is rotatably carried in a grinding wheelhead, and moves in a horizontal plane at an angle to the workpiece axis and essentially parallel to the wheel plane, presenting the juncture of the frusto-conical surfaces to the juncture of shoulder and diameter on the workpiece. The regulating wheel head is carried on a ramp, making an angle with the horizontal grinding wheelhead way so as to contact the workpiece in an upward approach along the ramp.

DESCRIPTION OF THE DRAWINGS

FIG. 4 is an elevational view of the prior art machine.

FIG. 5 is a plan view of the prior art machine performing a shoulder grinding operation.

FIG. 6 is a view taken along the line 6—6 of FIG. 5.

FIG. 7 is an elevational view of the prior art machine fitted with a frusto-conical grinding wheel.

FIG. 7*a* is an enlarged view of FIG. 7.

FIG. 8 is a sectional view taken through the grinding wheel and workpiece of FIG. 7, along the line 8—8.

DESCRIPTION OF THE PREFERRED EMBODIMENT

Figure 1:
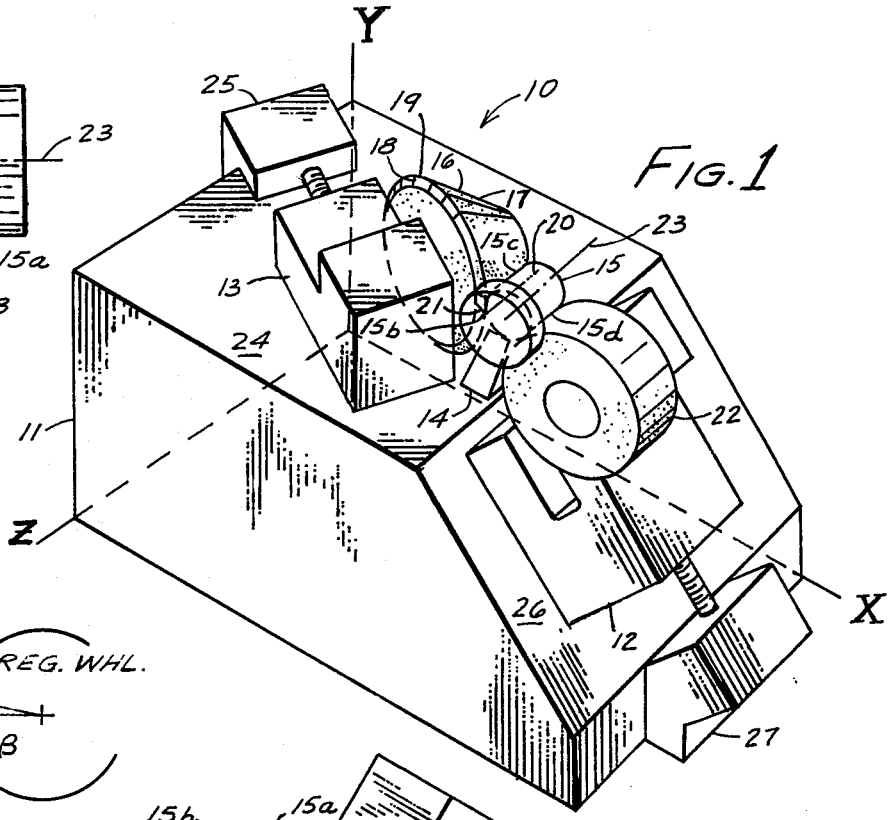
FIG. 1 is a front perspective view of an angular feed centerless grinder.

Referring now to the drawings, and particularly to FIG. 1 thereof, there is shown an angular feed centerless grinder 10, having a machine base 11 which carries a regulating wheelhead 12 and a grinding wheelhead 13. A work support 14 is carried by the base 11 and is located between the wheelheads 12, 13, for supporting a workpiece 15 of revolution during a grind operation. A grinding wheel 16 is rotatably carried in the grinding wheelhead 13 and the grinding wheel 16 has a frusto-conical main surface 17 of revolution for performing a diametral grind on the workpiece 15. A frusto-conical secondary surface 18 of revolution is also provided on the grinding wheel 16 wherein the secondary surface 18 is adapted to grind a shoulder **15*a* on the workpiece 15. The juncture 19 of the frusto-conical surfaces 17, 18 is adapted to coincide with the juncture 15*b* of the diametral surface 15*c* of the workpiece 15 and the adjacent shoulder 15*a*, the wheel 16 contacting the diametral surface 15*c* along an axial line of contact 20 and contacting the shoulder surface 15*a* along a radial line of contact 21. The regulating wheel 22 is generally cylindrical in form, rotatably journaled in the regulating wheelhead 12, and is adapted to contact the workpiece 15 along an axial line of contact 15*d***.

It is necessary to provide relative movement between the workpiece 15 and the respective wheelheads 12, 13 so as to allow for feed movement during grinding and/or for compensating movement after conditioning the wheels 16, 22. Here it may be noted that in the illustrated embodiment, the regulating wheelhead movement is used primarily for compensation of regulating wheel wear. In the preferred embodiment, the centerline 23 of the workpiece 15 is held stationary while the wheelheads 12, 13 are moved toward, and away from, the workpiece 15. For convenience in following the movement of the respective wheelheads 12, 13, a triordinate measuring system having mutually perpendicular ordinates "X", "Y", and "Z", is applied with the "Z" ordinate parallel to the grinding wheel contact line 20. As shown, the grinding wheelhead 13 moves along a way surface 24 on the base 11 parallel to the "XZ" plane and at an angle to the "XZ" plane, as defined by the centerline 23 of the workpiece 15, so as to present the wheel 16 properly to the shoulder and diametral surface juncture **15*b*. In doing so, the feed vector, "Fg" has perpendicular components which move the grinding wheelhead 13 along "X", and "Z" directions, simultaneously. A feed unit 25 is provided in connection with the wheelhead 13 to provide the proper feed vector, "Fg" and the feed unit 25 is stationary with respect to the base 11**.

The regulating wheelhead 12 is slidably carried on a ramp way surface 26 on the base 11, with motion parallel to the "XY" plane and at an angle to the "XZ plane", or grinding wheel way surface 24, so as to feed the regulating wheelhead 12 to contact the workpiece 15 along a line less than 180° from the grinding wheel contact line 20. In moving on the ramp surface 26, the feed vector, "Fr", of the regulating wheelhead 12 has components along "X", and "Y" directions, simultaneously. A feed unit 27 is stationarily held on the base 11 and is in connection with the regulating wheelhead 12 to provide the suitable regulating wheel feed vector, "Fr".

Figure 1A:
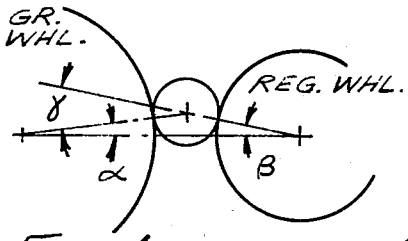
FIG. 1*a* depicts grinding terminology.

By way of background, FIG. 1*a* illustrates the terminology used by persons in the art to describe the roundness-generating geometry in a centerless grinding setup: angle "alpha", between the lines-of-centers of the grinding wheel-regulating wheel and grinding wheel-workpiece; angle "beta", between the lines-of-centers of the grinding wheel-regulating wheel and regulating wheel-workpiece; angle "gamma" the acute angle found between the lines-of-centers of the grinding wheel-workpiece and regulating wheel-workpiece (gamma = alpha + beta).

Figure 2:
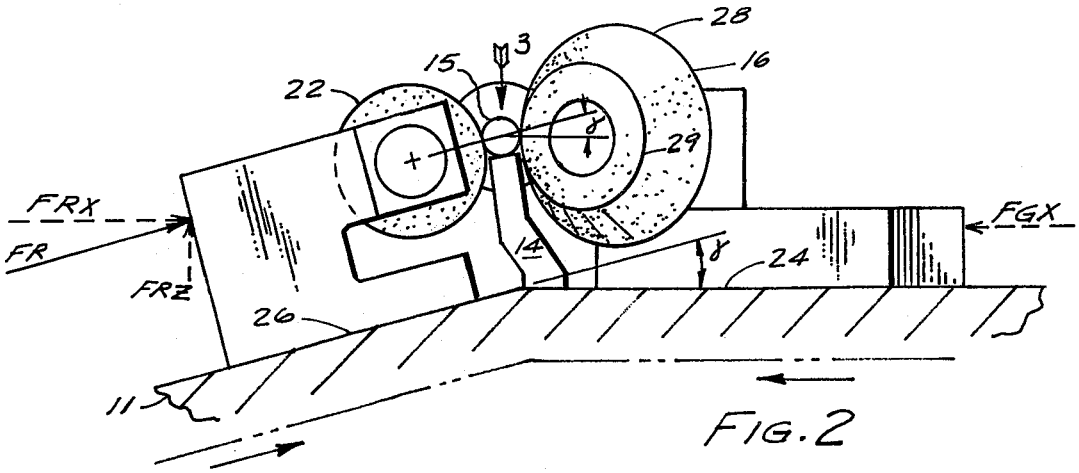
FIG. 2 is a rear elevational view of the grinder of FIG. 1 depicting a grinding wheelhead carried on a horizontal plane and the regulating wheelhead carried on a ramp at an angle to the horizontal plane.

FIG. 2 illustrates in more detailed planar fashion the attitude of the grinding wheel 16 and regulating wheel 22 to the workpiece in the "X-Z" plane. In this view, it is seen that the way surfaces 24, 26 of the base 11 form an included obtuse angle, (180°-"gamma"), "gamma" being necessary in centerless grinding to achieve a "rounding-up" affect on a workpiece 15 as described in connection with FIG. 1*a* as is well-known in the art. In this view, the workpiece 15 is seen circular, as is the regulating wheel 22. The grinding wheel 16, however, being frusto-conical in shape, has a large diameter 28 at one end and a small diameter 29 at the other end which appear elliptical, having their minor axes colinear, and the wheel 16 is adapted to present a conical side parallel to, and in contact with, the workpiece 15. Thus, it may be seen that, as the wheel cone is diminished due to wear and dressing, the relationship of the wheel 16 to the workpiece 15 will not change since the conical surface is held parallel to the workpiece.

Figure 3:
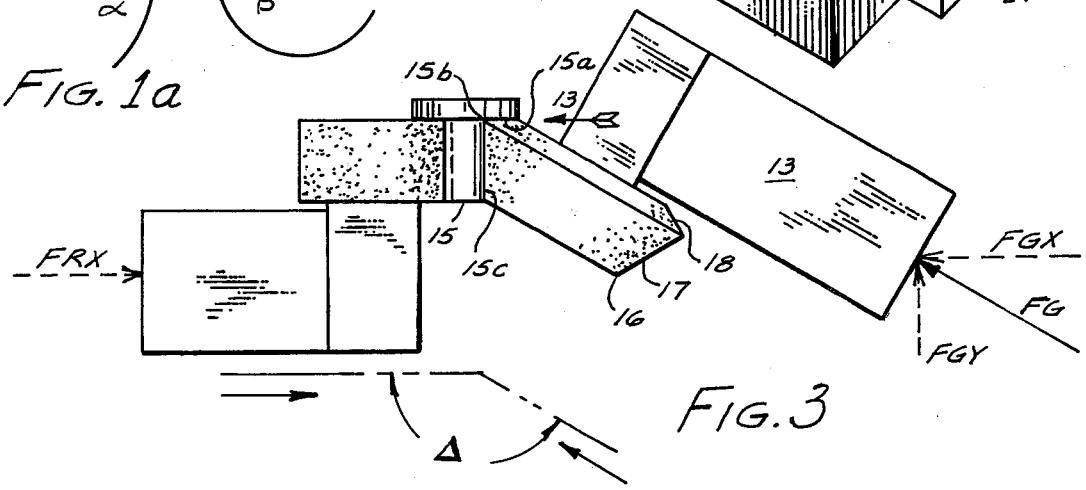
FIG. 3 is a plan view taken in the direction of arrow 3 of FIG. 2.

The plan view shown in FIG. 3 illustrates the attitude of the grinding wheel 16 in its approach to the workpiece 15, having its feed vector, "Fg", angled relative to the feed direction of the regulating wheelhead 12 at an included obtuse angle, "delta" so as to feed the wheel 16 into the juncture **15*b* of the diametral and shoulder surfaces 15***a, c* of the workpiece 15, contacting both surfaces 15*a, c,* simultaneously with the frusto-conical surfaces 17, 18 of the grinding wheel 16.

The prior art grinding machine 30, as depicted in FIG. 4, illustrates that a circular workpiece 31 of revolution is located on a work support 32 between the regulating and grinding wheelheads 33, 34 and the centerline 35 of the workpiece 31 is positioned at a dimension "A" above the line of centers 36 between the regulating and grinding wheels 37, 38. The regulating and grinding wheelheads 33, 34 are relatively fed with respect to the workpiece 31 along the line of centers 36 as indicated by the arrows. An angle, "gamma", between the lines of centers 39, 40 of the workpiece 31 and wheels 37, 38 respectively, is formed by locating the workpiece 31 above the wheel centers 36. Thus, a "rounding-up" triangle is formed having the workpiece 31 at the apex of the triangle. If "A" (altitude of the triangle) is held constant, as is the case with the conventional grinders, and the wheels 37, 38 are reduced in size and compensatingly fed into contact with the workpiece 31, it may be seen that angle "gamma" will vary throughout the life of the wheels 37, 38 with respect to a given workpiece 31. Once established, more constant "rounding up" parameters may be maintained by keeping angle "gamma" constant, which may be effected by feeding the wheels 37, 38 directly towards the workpiece 31, as in the instant invention.

FIG. 5 depicts a shoulder grinding operation on the prior art centerless grinding machine 30, wherein the workpiece shoulder 41 is ground by the side 42 of the grinding wheel 38 as the work diameter 43 is contacted by the cylindrical workface 44 of the wheel 38. The side 42 of the wheel 38 may sometimes be relieved, as shown by the phantom line 45, to achieve better surface flatness control, but, as shown in FIG. 6, relieving the wheel 38 results in having a mere rim 46 of a grinding wheel 38 in contact with the shoulder 41 and, wheel breakdown may thereby be accelerated. Further, as depicted in FIG. 6, a "cross-hatching" 47 of the shoulder 41 occurs as previously ground areas are reground by presenting them in a differing attitudes to the grinding wheel 38.

If the prior art grinding machine 30 of FIG. 4 were fitted with a frusto-conical grinding wheel 48 as depicted in FIG. 7 and advanced toward the workpiece 31 at angle "delta" as in the instant invention, an unusual and undesirable geometrical relationship between the workpiece 31 and grinding wheel 48 would result. Specifically, as indicated by FIG. 7, the regulating and grinding wheels 37, 48 are fed along the line of centers 36, in the direction of the arrows. The regulating wheel 37 and workpiece 31 are cylindrical as depicted, and in this view, the sides 49, 50 of the grinding wheel 48 are depicted as ellipses, having radii of curvature, "Rc" and "*rc*", respectively, with their minor axes lying along the line of centers 36 between the wheels 37, 48. It may be seen that as the workpiece 31 is contacted by the larger side 49 of the frusto-conical wheel 48, having the greater elliptical radius of curvature, "Rc", the smaller curvature, "*rc*", is incapable of contacting the workpiece 31, except at a point where the conical surface 31 of the wheel 48 is parallel to the workpiece 31. This condition occurs only at the point where the minor axes of the ellipses are coincident, i.e., at the line of centers 36 of the wheels 37, 48. To further depict the relationship of the wheel 48 and workpiece 31, FIG. 8 illustrates the grinding wheel 48 in contact with the workpiece at its largest side 49, but the wheel conical surface 51 is not in contact with the workpiece at its smallest side 50. Further, if the wheel has a secondary conical surface 52, normal to the conical surface 51, an undesirable angle may result between the shoulder 41 and diameter 43 of the workpiece 31. Succinctly stated, the workpiece 31 must lie on the conical surface 51 of the wheel 48 such that their two axes fall on the same plane, and to accomplish this with the prior art machine 30 would necessarily involve an arrangement to tilt the workpiece 31, or to angularly position it along the wheel surface 51. Even if such a tilt position could be attained, once the grinding wheel 48 changes size a certain amount and is moved solely along the line of centers 36, the workpiece 31 would have to be frequently readapted to contact a new grinding wheel cone.

Figure 10:
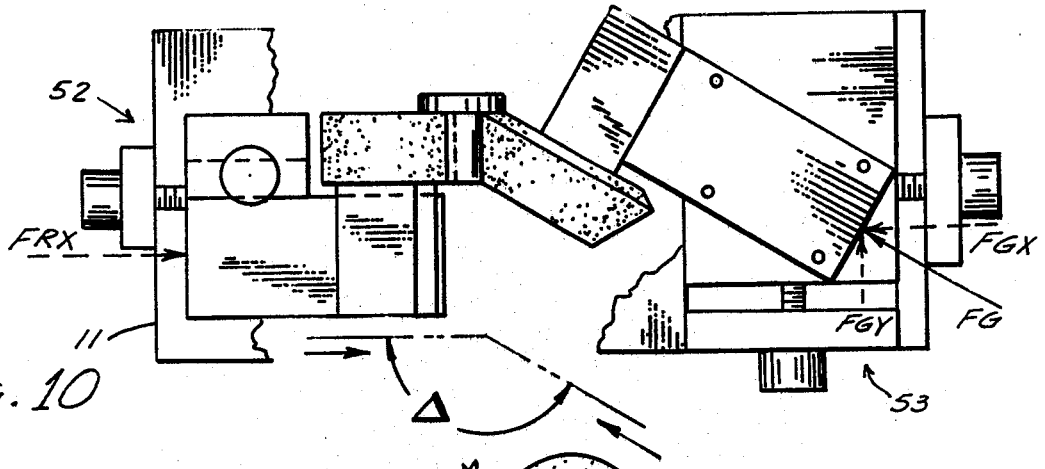
FIG. 10 is a plan view of an alternate embodiment of the machine of the present invention taken in the direction of arrow 10 of FIG. 9.
Figure 9:
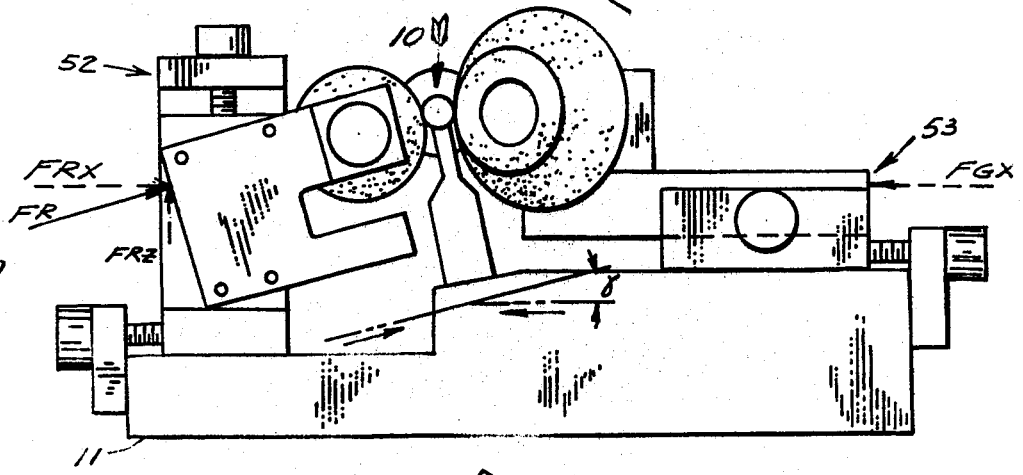
FIG. 9 is an elevational view of an alternate embodiment of the machine of the present invention.

FIGS. 9 and 10 are views of an alternate embodiment of the within invention, illustrating that the base 11 may be fitted with coordinate slide systems 52, 53 which may be moved to obtain the desired resultant feed vectors "Fg", "Fr", as hereinbefore described in FIGS. 2 and 3.

Figure 12:
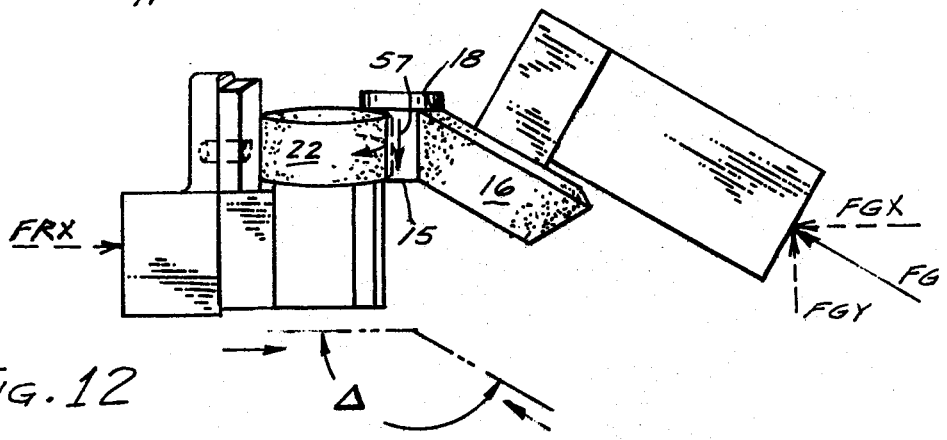
FIG. 12 is a plan view of the machine of the present invention having the regulating wheelhead swiveled.
Figure 11:
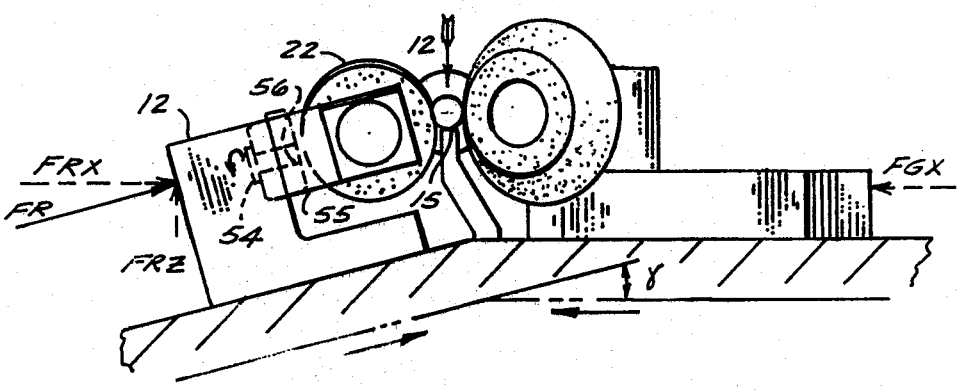
FIG. 11 is an elevational view of the machine of the present invention illustrating regulating wheelhead swivel action.

FIGS. 11 and 12 illustrate that the regulating wheelhead 12 may be adapted with a pivot pin 54, having its axis passing through the wheel 22 and workpiece 15, wherein a regulating wheelhead swivel housing 55 has a cooperating bore 56 adapted to be carried on the pivot pin 54, and the housing 55 may be pivoted a small amount so as to obtain an axial feed component 57 on the workpiece 15 for performing a shoulder grinding operation, wherein the workpiece 15 is propelled into shoulder engagement with the frusto-conical secondary surface 18 of the grinding wheel 16. This is a preferred method of obtaining an axial feed component, well-known in the art.

Figure 13:
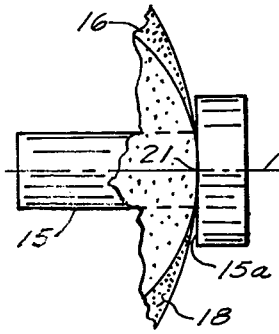
FIG. 13 is a view taken in the direction of arrow 13 of FIG. 3 depicting a frusto-conical grinding wheel performing a shoulder grinding operation.

FIG. 13 is an elevational view showing the grinding wheel 16 of the present invention in contact with the shoulder 15*a* of a workpiece 15 of revolution, wherein the frusto-conical secondary surface 18 of the grinding wheel 16 contacts the workpiece along a radial line of contact 21 established by having the side of the cone parallel to the shoulder 15*a*. In this fashion, therefore, it is seen that as the cone is decreased in size, the shoulder grinding contact line 21 will not change, since the side of the cone is presented in the same attitude at the work center line 23.

It is not intended that the invention be restricted to the embodiments shown in the drawings but rather that the invention also comprises all such designs and modifications as come within the scope of the appended claims.

What is claimed is:

1. An improved centerless grinder, having a grinding wheel and regulating wheel rotatably journaled in respective grinding and regulating wheelheads, further having a work-contacting line defined on said grinding wheel parallel with a first ordinate of a mutually perpendicular triordinate system, wherein the improvement comprises:

a. means to move said regulating wheelhead relative to a workpiece simultaneously in directions substantially parallel to second and third ordinates of said system respectively; and b. means to move said grinding wheelhead relative to a workpiece simultaneously in directions substantially parallel to first and second ordinates of said system, respectively.

2. The centerless grinder of claim 1, further comprising a frusto-conical main surface of revolution on said grinding wheel adapted for contacting a workpiece of revolution along said contact line.

3. The centerless grinder of claim 2, further comprising a frusto-conical secondary surface of revolution on said grinding wheel adapted for contacting a workpiece of revolution along a second contact line.

4. The centerless grinder of claim 3, wherein said second contact line lies in a direction substantially parallel to said second ordinate of said system.

5. An angular centerless grinder, comprising:

a. a base;

b. a grinding wheelhead carried on said base;

c. a regulating wheelhead carried on said base;

d. a work support carried on said base between said grinding and regulating wheelheads;

e. a grinding wheel, rotatably journaled in said grinding wheelhead, and having a frusto-conical main surface of revolution adapted to contact a workpiece of revolution along a defined line of contact, wherein said contact line and the respective axes of rotation of said grinding wheel and workpiece lie in a common grinding plane;

f. a regulating wheel, rotatably journaled in said regulating wheelhead and adapted to contact a workpiece of revolution and further adapted for relative movement in a first linear direction radially of a workpiece in a second plane perpendicular to said grinding plane; and g. means to provide relative feed movement between said grinding wheel and said workpiece in a second linear direction along said grinding plane, wherein said first and second linear directions form a first obtuse included angle in said grinding plane and a second obtuse included angle in said plane perpendicular to said grinding plane.

* * * * *

UNITED STATES PATENT AND TRADEMARK OFFICE

CERTIFICATE OF CORRECTION

PATENT NO. : 4,083,151

DATED : April 11, 1978

INVENTOR(S) : Wilbur F. Jessup; Rudolf J. A. Kimmelaar

It is certified that error appears in the above-identified patent and that said Letters Patent are hereby corrected as shown below:

In the Drawings

In Fig. 2, "FRZ" should read -- FRY --;

In Fig. 3, "FGY" should read -- FGZ --;

In Fig. 9, "FRZ" should read -- FRY --;

In Fig. 10, "FGY" should read -- FGZ --;

In Fig. 11, "FRZ" should read -- FRY --;

In Fig. 12, "FGY" should read -- FGZ --.

Signed and Sealed this

*Eleventh* Day of *December 1979*

[SEAL]

*Attest:*

*Attesting Officer*

SIDNEY A. DIAMOND

*Commissioner of Patents and Trademarks*